US011944149B2

(12) United States Patent
Halldin et al.

(10) Patent No.: US 11,944,149 B2
(45) Date of Patent: Apr. 2, 2024

(54) HELMET

(71) Applicant: MIPS AB, Täby (SE)

(72) Inventors: Peter Halldin, Täby (SE); Kim Lindblom, Täby (SE)

(73) Assignee: MIPS AB (SE)

( * ) Notice: Subject to any disclaimer, the term of this patent is extended or adjusted under 35 U.S.C. 154(b) by 387 days.

(21) Appl. No.: 16/960,253

(22) PCT Filed: Jan. 4, 2019

(86) PCT No.: PCT/EP2019/050171
§ 371 (c)(1),
(2) Date: Jul. 6, 2020

(87) PCT Pub. No.: WO2019/134973
PCT Pub. Date: Jul. 11, 2019

(65) Prior Publication Data

US 2021/0059345 A1 Mar. 4, 2021

(30) Foreign Application Priority Data

Jan. 8, 2018 (GB) ..... 1800256

(51) Int. Cl.
*A42B 3/06* (2006.01)
*A42B 3/12* (2006.01)

(52) U.S. Cl.
CPC ..... *A42B 3/064* (2013.01); *A42B 3/125* (2013.01); *A63B 2243/007* (2013.01)

(58) Field of Classification Search
CPC ..... A42B 3/064; A42B 3/06; A42B 3/063; A42B 3/068; A42B 3/127; A63B 71/10
USPC ..... 2/411, 414
See application file for complete search history.

(56) References Cited

U.S. PATENT DOCUMENTS

| | | | | |
|---|---|---|---|---|
| 2004/0117896 | A1 | 6/2004 | Madey et al. | |
| 2007/0169251 | A1* | 7/2007 | Rogers | A42B 3/324 2/418 |
| 2012/0060251 | A1 | 3/2012 | Schimpf | |
| 2012/0198604 | A1 | 8/2012 | Weber et al. | |
| 2013/0061371 | A1 | 3/2013 | Phipps et al. | |
| 2013/0185837 | A1 | 7/2013 | Phipps et al. | |
| 2013/0283507 | A1 | 10/2013 | Baty | |
| 2016/0073723 | A1 | 3/2016 | Halldin et al. | |
| 2016/0316829 | A1 | 11/2016 | Guerra | |
| 2016/0369861 | A1 | 12/2016 | Phipps et al. | |
| 2017/0105470 | A1 | 4/2017 | Eaton | |
| 2017/0112220 | A1 | 4/2017 | Suddaby | |

(Continued)

FOREIGN PATENT DOCUMENTS

| | | |
|---|---|---|
| JP | 2015513008 | 4/2015 |
| WO | WO 96/14768 | 5/1996 |

(Continued)

*Primary Examiner* — Jameson D Collier
(74) *Attorney, Agent, or Firm* — Perkins Coie LLP

(57) ABSTRACT

A helmet comprising: an inner shell; an outer shell; a sliding interface between the inner shell and the outer shell; and a switch configured to be selectively switchable between first and second discrete modes, the first mode allowing relative sliding between the inner shell and the outer shell at the sliding interface in response to an impact to the helmet, the second mode preventing relative sliding between the inner shell and the outer shell at the sliding interface.

20 Claims, 5 Drawing Sheets

(56) References Cited

U.S. PATENT DOCUMENTS

| | | | |
|---|---|---|---|
| 2017/0119080 | A1 | 5/2017 | Allen et al. |
| 2018/0153243 | A1 | 6/2018 | Pradeep |

FOREIGN PATENT DOCUMENTS

| | | | |
|---|---|---|---|
| WO | WO 2001/045526 | | 6/2001 |
| WO | WO 2008/103107 | | 8/2008 |
| WO | WO 2011/139224 | | 11/2011 |
| WO | 2013134063 | A1 | 9/2013 |
| WO | WO 2016/077503 | | 5/2016 |
| WO | 2017/148958 | A1 | 9/2017 |
| WO | WO 2018/197207 | | 11/2018 |

* cited by examiner

HELMET

RELATED APPLICATIONS

This application is a 35 USC § 371 National Stage application of International Application No. PCT/EP2019/050171, entitled "HELMET," filed on Jan. 4, 2019, which claims the benefit of United Kingdom Patent Application No. 1800256.8, filed on Jan. 8, 2018 the disclosures of which applications are incorporated herein by reference in their entireties.

The present invention relates to helmets.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snow-boarding, skating, skateboarding, equestrian activities, American football, baseball, rugby, cricket, lacrosse, climbing, golf, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. In some cases, comfort padding within the helmet can act as the attachment device. The attachment device can also be provided in the form of a plurality of physically separate parts, for example a plurality of comfort pads which are not interconnected with each other. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. Nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotation energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include concussion, subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either SDH, DAI or a combination of these injuries can be suffered. Generally speaking, SDH occur in the case of accelerations of short duration and great amplitude, while DAI occur in the case of longer and more widespread acceleration loads.

As discussed in the above-referenced patent applications, helmets have been developed in which a sliding interface may be provided between two shells of the helmet in order to assist with management of an oblique impact. However, the present inventors have identified that, in some situations, in particular those during which the wearer of the helmet is not exposed to the more serious risks for which the helmet is designed, the sliding of one part of the helmet to another may inconvenience the user, in particular if the extent of sliding of one part to another becomes too large.

The present invention aims to at least partially address this problem.

According to the present invention, there is provided a helmet comprising an inner shell, and outer shell, and a sliding interface between the inner shell and the outer shell. The helmet further includes a switch, configured to be selectively switchable between first and second discrete modes. In the first mode, relative sliding between the inner shell and the outer shell at the sliding interface in response to an impact to the helmet may be permitted. In the second mode, sliding between the inner shell and the outer shell at the sliding interface in response to an impact to the helmet may be prevented.

The invention is described below by way of non-limiting examples, with reference to the accompanying drawings, in which.

Figure 1:
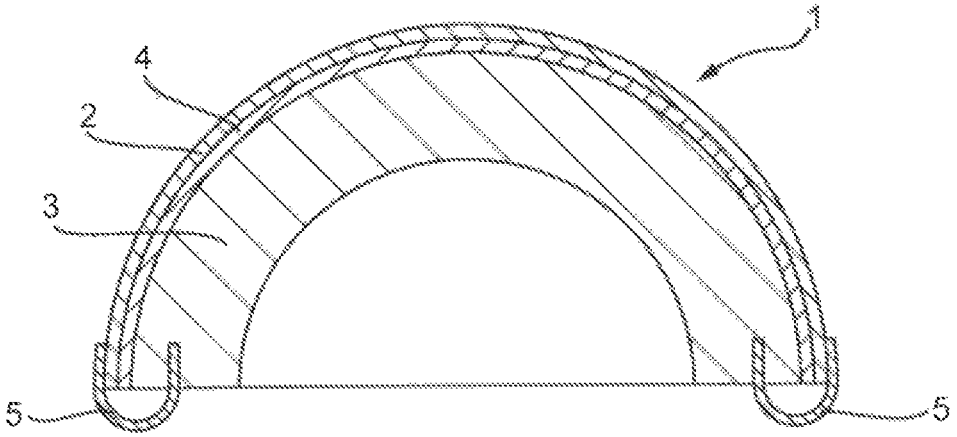
FIG. 1 depicts a cross section through a helmet for providing protection against oblique impacts.

The proportions of the thicknesses of the various layers in the helmets depicted in the figures have been exaggerated in the drawings for the sake of clarity and can of course be adapted according to need and requirements.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer.

Arranged between the outer shell 2 and the inner shell 3 is a sliding layer 4 or a sliding facilitator, and thus makes possible displacement between the outer shell 2 and the inner shell 3. In particular, as discussed below, a sliding layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connectors may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre or Kevlar.

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extend (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the sliding layer 4 or sliding facilitator, for example oil, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. The number of sliding layers and their positioning can also be varied, and an example of this is discussed below (with reference to FIG. 3B).

As connecting members 5, use can be made of, for example, deformable strips of plastic or metal which are anchored in the outer shell and the inner shell in a suitable manner.

Figure 2:
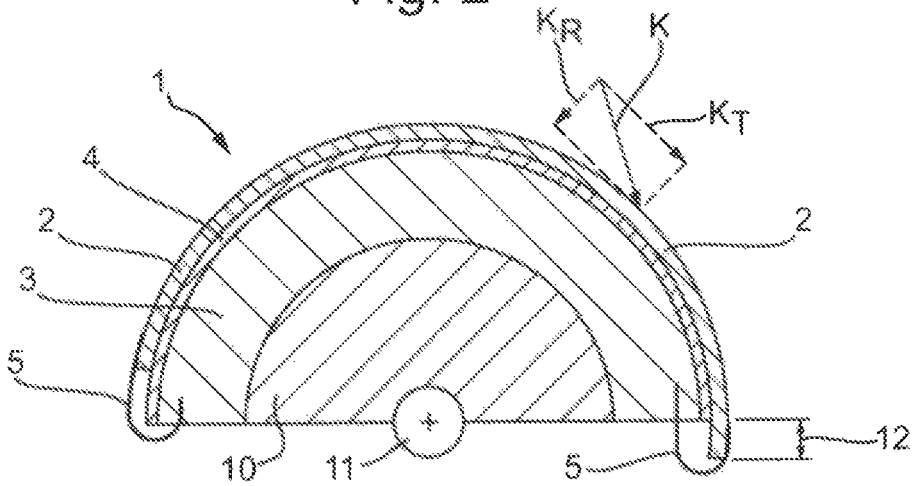
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force $K_R$ against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being deformed. A reduction in the torsional force transmitted to the skull 10 of roughly 25% can be obtained with such an arrangement. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
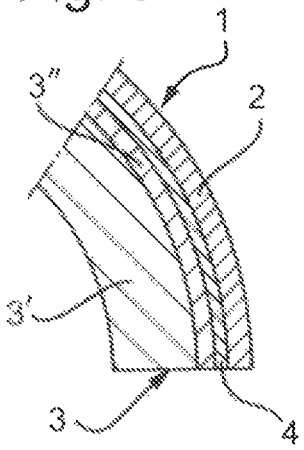
FIGS. 3A, 3B & 3C show variations of the structure of the helmet of FIG. 1.
Figure 3B:
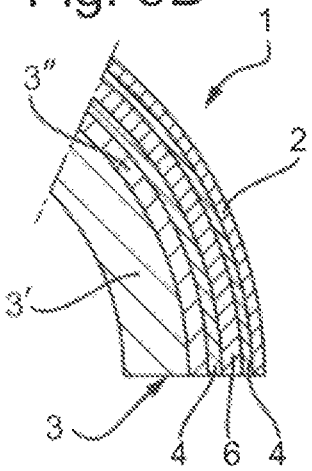
Figure 3C:
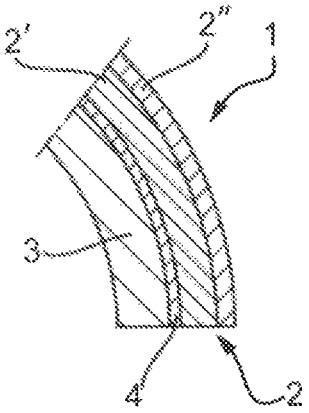

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" is preferably harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the outer shell 2 is embodied differently to previously. In this case, a harder outer layer 2" covers a softer inner layer 2'. The inner layer 2' may, for example, be the same material as the inner shell 3.

Figure 4:
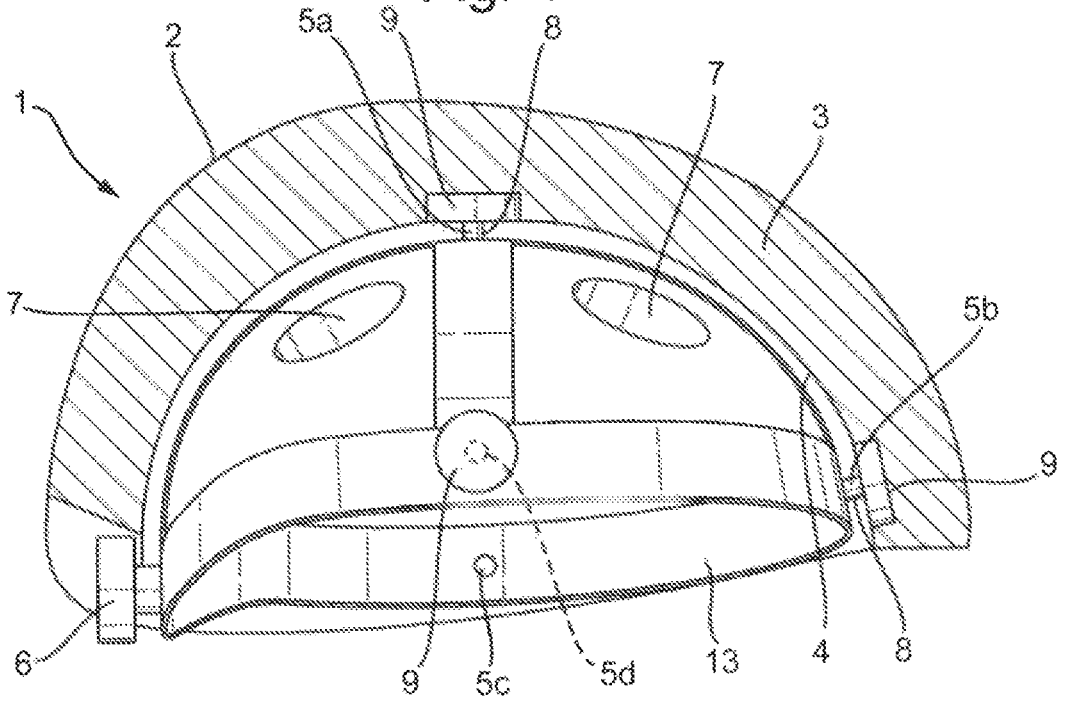
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost sided of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 4 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, FEP, PE and UHMWPE, or a powder material which could be infused with a lubricant. The low friction material could be a fabric material. As discussed, this low friction material could be applied to either one, or both of the sliding facilitator and the energy absorbing layer The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
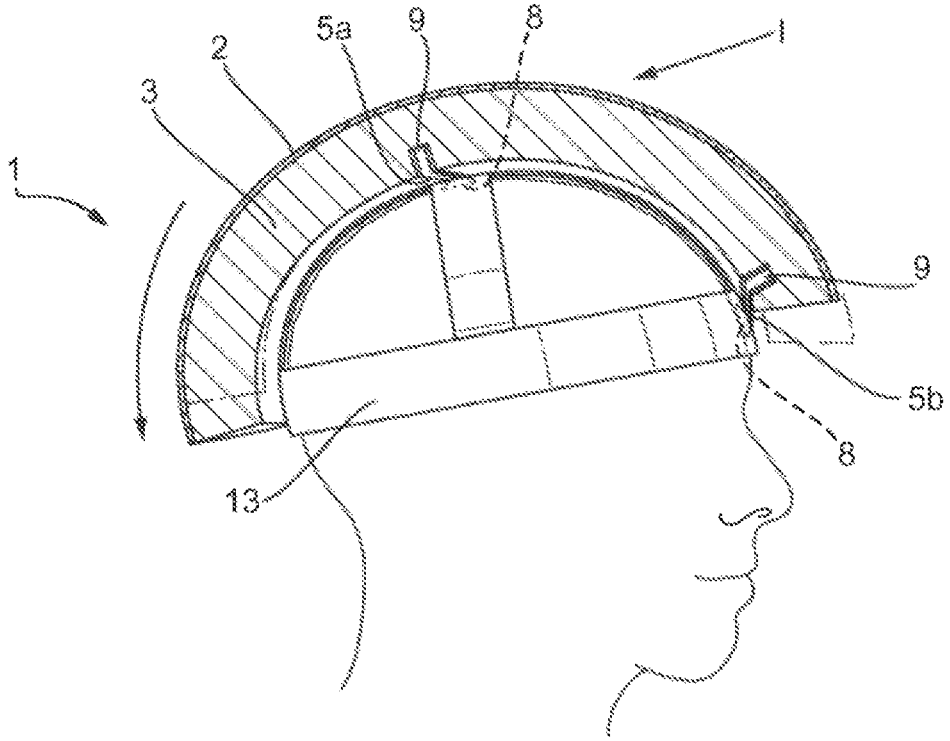
FIG. 5 depicts an alternative way of connecting the attachment device of the helmet of FIG. 4.

FIG. 5 shows an embodiment of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries such as subdural haematomas, SDH, blood vessel rapturing, concussions and DAI is thereby reduced.

In an arrangement of the present invention, a helmet is provided with a switch configured to be selectively switchable between two discrete modes. In the first mode, relative sliding between an inner shell and an outer shell of the helmet may be possible in response to an impact to the helmet. In the second mode, relative sliding between the inner shell and the outer shell is prevented. The inner and outer shells of the helmet for which the switch controls relative sliding may, in general, be any two layers of a helmet between which a sliding interface is provided. In particular, such a switch may be provided to any of the helmet arrangements discussed above.

For example, in an arrangement, the inner shell may be a layer that is configured to contact the head of the wearer and/or to be mounted to the head of the wearer and the outer shell may be an energy absorbing layer for absorbing impact energy. In another arrangement, the inner shell may be a first energy absorbing layer for absorbing impact energy and the outer shell may be a second energy absorbing layer for absorbing impact energy. In a further example, the inner shell may be an energy absorbing layer for absorbing impact energy and the outer shell may be a relatively hard shell, for example formed from a material that is harder than the material used to form the energy absorbing layer.

As is explained below in relation to specific examples of arrangements of the switch, the switch may be configured such that it can be manually switched between the first and second modes by a wearer of the helmet. Accordingly, the switching between the first and second modes may be performed after a user has purchased a helmet rather than being set, for example, in the manufacturing/assembly process. A user may also be able to repeatedly switch backwards and forwards between the first and second modes.

In some arrangements, a tool may be used in order to complete switching between the first and second modes. In other arrangements, the switch may be configured such that the user can switch between the first and second modes without requiring the use of a tool. For example, the switch may be configured such that switching between the first and second modes may be effected using their hands/fingers.

In general, a switch may be provided at any convenient point on a helmet. In some arrangements, the switch may be provided at the edge of a helmet. This may be convenient for providing access for a user to the switch. For example, this may permit the user to switch between the first and second modes while wearing the helmet. Alternatively or additionally, providing a switch at an edge of a helmet may facilitate the manufacture of a helmet with such a switch.

Figure 6:
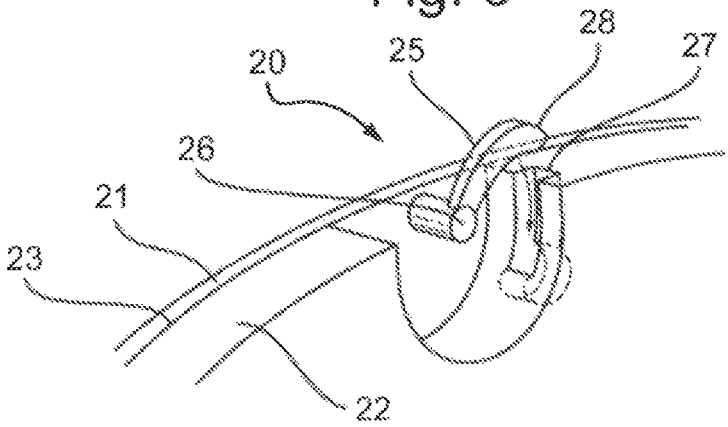
FIG. 6 depicts an arrangement of a moveable lock.

FIG. 6 depicts an example of a helmet having a switch 20 provided at an edge of a helmet. In the arrangement shown, the helmet includes an outer shell 21 and an inner shell 22 with a sliding interface 23 provided between the two shells. The switch 20 includes a moveable lock 25 that can move between first and second positions that correspond to the first and second modes of the switch 20.

FIG. 6 depicts the lock 25 in the first position. As shown, The lock 25 is mounted to the outer shell 21 by a rotatable mounting point 26. In the first position, the lock 25 is not engaged with the inner shell 22. Consequently, the inner shell 22 may slide relative to the outer shell 21 at the sliding interface.

The lock 25 may be moved to the second position by rotating the lock 25 about the rotatable mounting point 26. When the lock 25 is rotated to the second position, an end 28 of the lock 25 engages with a recess 27 within the inner shell 22. The engagement of the lock 25 with the inner shell 22 may be configured to prevent movement of the inner shell 22 relative to the outer shell 21. In this way, relative sliding between the inner shell 22 and the outer shell 21 at the sliding interface 23 may be prevented, setting the switch 20 to the second mode.

It should be appreciated that variations of the arrangement shown in FIG. 6 may be provided. For example, the lock 25 may be rotatably mounted to the inner shell and configured such that it can engage with, and disengage from, the outer shell. Alternatively or additionally, the end of the lock may be configured to engage with the shell to which it is not mounted by a means other than by entering a recess in that shell. For example, the moveable lock may be configured to engage with a protrusion that protrudes from the shell. In general, a variety of forms of detachable connection may be provided between the lock and the shell other than the shell to which it is mounted.

In an arrangement, the moveable lock 20 may be configured such that it can engage with the shell other than the shell to which it is mounted in order to prevent relative sliding between the shells without requiring a part of the lock to be inserted within a recess. For example, in the arrangement depicted in FIG. 7, the lock 20 may include a tab 29 that is rotatably mounted on the edge of the outer shell 21. In a first position, the tab 29 may be arranged adjacent to the outer surface of the outer shell 21. In the second position, the tab 29 may abut the edge of the inner shell 22, preventing the inner shell 22 from sliding relative to the outer shell 21.

Figure 7:
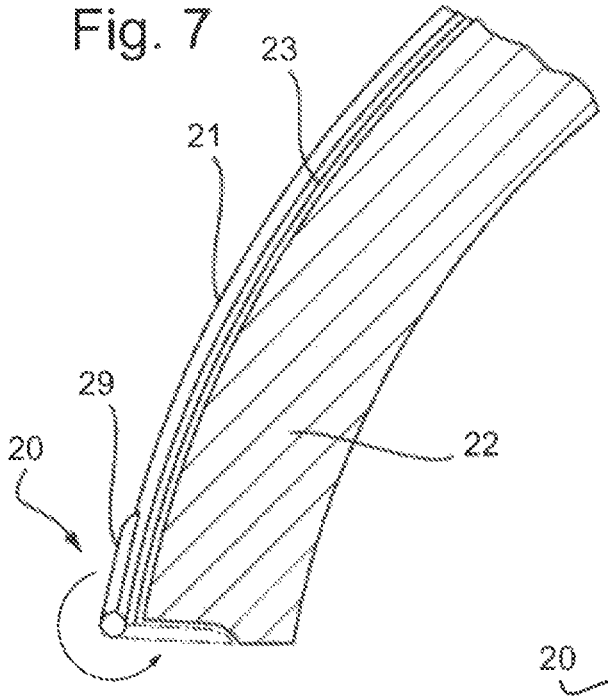
FIG. 7 depicts an arrangement of a moveable lock.

As shown in FIG. 7, although in such an arrangement the rotatably mounted tab 29 may engage with the inner shell 22 without being inserted into a recess in the inner shell 22, a shallow recess may in any case be provided to receive the tab 29 in the second position. For example, this may reduce the likelihood of the tab 29 being accidentally flipped back to the first position.

Figure 8:
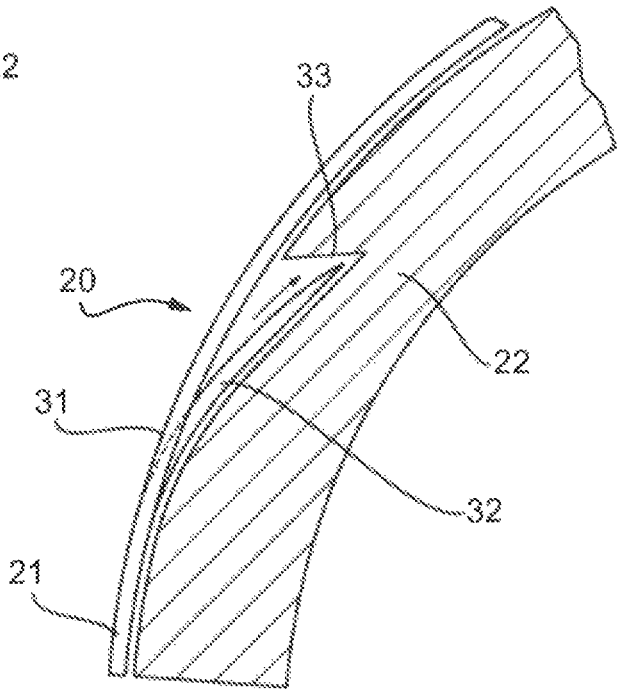
FIG. 8 depicts an arrangement of a moveable lock.
Figure 9:
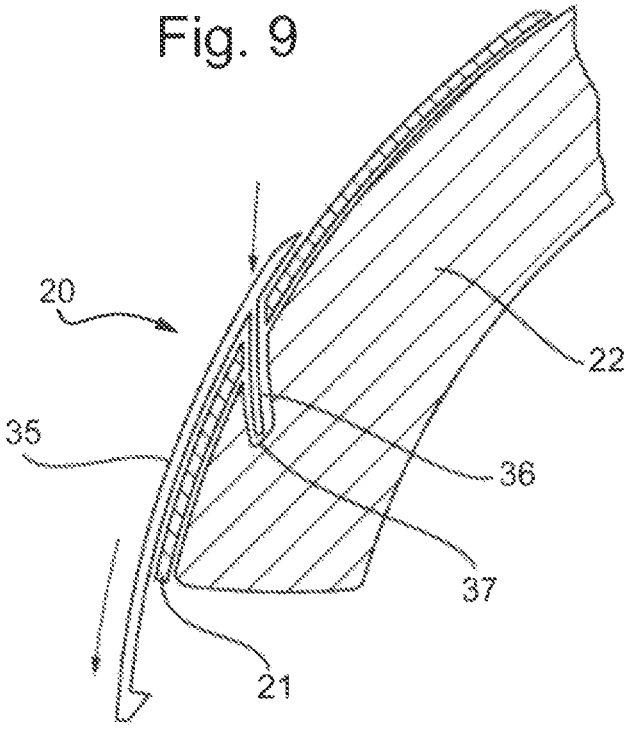
FIG. 9 depicts an arrangement of a moveable lock.

FIGS. 8 and 9 depict alternative arrangements of a moveable lock 20. The arrangements shown in FIGS. 8 and 9 differ from the arrangement shown in FIG. 6 in that the lock 20 includes a component that is slidably mounted to the outer shell 21 rather than rotatably mounted as in the arrangement shown in FIG. 6.

In this context, a slidably mounted component may be one that is arranged such that it can move in a substantially linear direction approximately parallel to the surface of the shell to which it is mounted. It will be appreciated that the movement may not be perfectly linear, namely in a straight direction, because it may correspond to the local curvature of the shell of the helmet. In the arrangement shown in FIGS. 8 and 9, the slidably mounted components 31, 35 are mounted to the outer shell 21. However, with appropriate modifications it will be appreciated that these components may alternatively be mounted to the inner shell 22.

In arrangement such as that depicted in FIG. 8, the lock 20 may have a protrusion 32 connected to the slidably mounted component 31 that is arranged such that, as the lock 20 is moved from the first position to the second position and back again, the protrusion 32 is inserted into, and withdrawn from, respectively, a recess 33 within the inner shell 22.

As shown, the protrusion 32 is arranged such that, at least when it is inserted into the recess 33, it extends at an angle relative to the direction in which the slidably mounted component 31 moves when it is moved between the first and second positions. In a corresponding manner to the arrangement discussed above shown in FIG. 6, when the protrusion 32 is inserted into the recess 33, it engages with the inner shell 22 in order to restrict movement of the inner shell 22 relative to the outer shell 21.

The arrangement depicted in FIG. 9 operates in a similar manner to the arrangement shown in FIG. 8, having a protrusion 36 connected to the slidably mounted component 35 that, upon operation of the lock 20 may be inserted into, and retracted from, a recess 37 within the inner shell 22.

The key functional difference between the arrangement depicted in FIGS. 8 and 9 are that, in the arrangement depicted in FIG. 8, sliding the slidably mounted component 31 in a direction from the top of the helmet to the edge of the helmet moves the lock 20 to the first position whereas, in the arrangement depicted in FIG. 9, moving the slidably mounted component 35 in a direction from the top of the helmet to the edge of the helmet moves the switch 20 to the second position.

Figure 10:
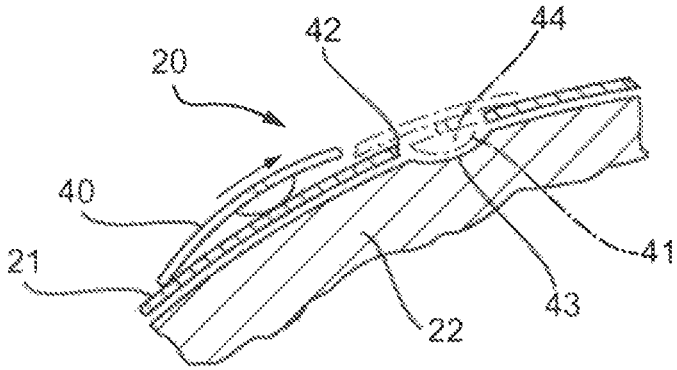
FIG. 10 depicts an arrangement of a moveable lock.

FIG. 10 depicts a further alternative arrangement of a slidably mounted lock 20. As shown, in this arrangement, the lock 20 includes a slidably mounted component 40, mounted on the outer surface of the outer shell 21, that includes a protrusion 41. In the arrangement depicted, when the slidably mounted component 40 is moved to the second position, the protrusion 41 passes through an opening 42 in the outer shell 21 and enters a recess 43 in the inner shell 22. The presence of the protrusion 41 within the recess 43 in the inner shell 22 may restrict sliding movement between the inner shell 22 and the outer shell 21.

The lock 20 may be configured such that the protrusion 41 is biased towards passing through the opening 42 in the outer shell 21 and entering the recess 43 in the inner shell 22 when the slidably mounted component 40 is moved to the second position. In an arrangement, this may be provided by providing a resilient member 44 between the slidably mounted component 40 and the protrusion 41 that biases the protrusion 41 towards the recess 43.

Alternatively or additionally, the slidably mounted component 40 may itself be resilient and arranged such that, in the first position, the slidably mounted component is deformed and presses the protrusion 41 against the outer surface of the outer shell 21. Once the protrusion 41 is aligned with the opening 42, the slidably mounted component 40 is biased to return to its undeformed state, forcing the protrusion 41 through the opening 43 and into the recess 43.

As shown in FIG. 10, in one arrangement, the surface of the protrusion 41 that engages with the inner shell 22 may have a rounded edge such that, as the slidably mounted component 40 is pushed back to the first position, namely slid in a substantially linear direction parallel to the surface of the outer shell in the region of the opening 42, the protrusion 41 is withdrawn from the recess 43 in the inner shell 22 and through the opening 42 in the outer shell 21. In other words, the engagement of the rounded edge of the protrusion with the edge of the recess 43 and/or opening 42 may force the protrusion in a direction substantially perpendicular to the surface of the outer shell 21 in the region of the opening 42. This may overcome the force biasing the protrusion into the recess 43.

In an arrangement, the moveable lock 20 may have a first part 51 mounted to one of the inner shell and the outer shell and a second part 52 that may be inserted into a recess 53 in the other shell by deforming a part of the lock 20.

Figure 11:
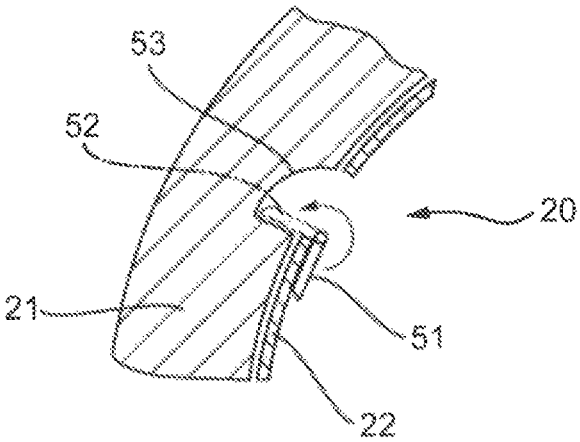
FIG. 11 depicts an arrangement of a moveable lock.

FIG. 11 depicts such an arrangement. In the arrangement depicted in FIG. 11, the first part 51 of the lock 20 is mounted to the inner shell 22. A second part 52 of the lock 50 may be inserted into a recess 53 in the outer shell 21. This may be effected by deformation of part of the lock 20, in particular, for example, a part of the lock between the first part 51 and second part 52. By insertion of the second part 52 of the lock 20 into the recess 53, sliding of the inner shell 22 relative to the outer shell 21 may be restricted.

It will be appreciated that, although in the arrangement depicted in FIG. 11 the first part 51 is mounted to the inner shell and the lock 20 is configured such that the second part 52 may be inserted in a recess 53 in the outer shell 21, this arrangement may be reversed. Similarly, it will be appreciated that, although FIG. 11 depicts an example of a lock applied to a helmet in which the inner shell 22 is relatively thin, for example configured to mount the helmet to the head of the wearer, and the outer shell 21 is an energy absorbing layer that is thicker than the inner shell 22, as with the other arrangements discussed above, this moveable lock may equally be applied to other helmet configurations.

In an arrangement, a helmet may have a plurality of locks 20 such as any of those discussed above. A helmet may have a plurality of locks 20 of one arrangement or may have plural locks constructed according to two or more of the arrangements discussed above.

In some arrangements, a single lock may, when in the second position, restrict movement of the inner shell relative to the outer shell in a first direction. The helmet may include a second lock that, when it is in its second position, restricts movement of the inner shell relative to the outer shell in a second direction that is different from the first direction.

For example, a helmet may have one or more locks that, in the second position, restrict rotation of the outer shell relative to the inner shell about an axis that extends from the front to the back of the head of the wearer and one or more locks that, in the second position, restrict rotation of the outer shell relative to the inner shell about an axis that extends from one side to a second side of the head of the wearer.

In an arrangement, a helmet may include a switch that comprises an interface engagement lock 60. The interface engagement lock 60 may be configured such that, in the second mode, it secures part of an outer surface of the inner shell 22 to a portion of the inner surface of the outer shell 21. This engagement between the surfaces of the inner shell 22 and the outer shell 21 may be configured to prevent sliding between the respective portions of the surfaces of the inner shell 22 and the outer shell 21. In turn this may restrict sliding of the inner shell 22 relative to the outer shell 21.

Figure 12:
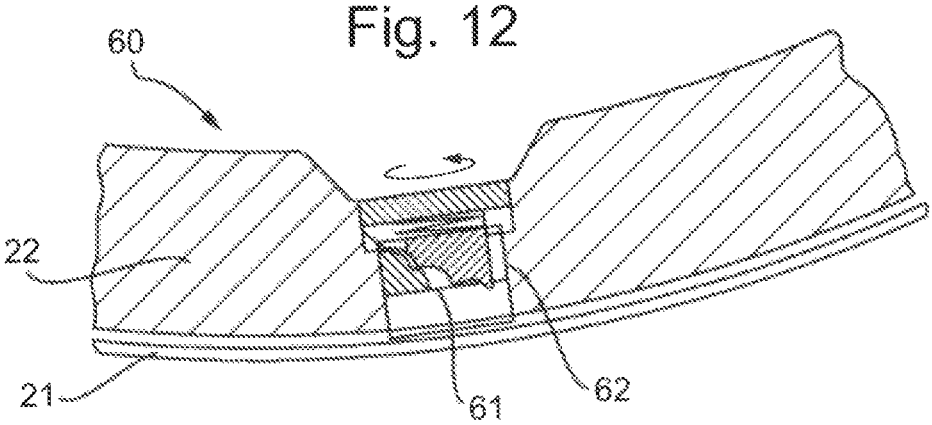
FIG. 12 depicts an arrangement of an interface engagement lock.

FIG. 12 depicts an arrangement of an interface engagement lock 60. In the arrangement depicted in FIG. 12, the interface engagement lock 60 includes a friction pad 61 that is mounted to the inner shell 22. The interface engagement lock 60 is arranged such that, in the first mode, the friction pad 61 either has no contact with the inner surface of the outer shell 21 or contacts it with sufficiently small force that the friction force between the friction pad 61 and the inner surface of the outer shell 21 does not significantly prevent sliding of the outer shell 21 relative to the inner shell 22 in the event of an impact to the helmet for which the helmet is designed. In the second mode, the friction pad 61 is pressed against the inner surface of the outer shell 21 such that a sufficient friction force is provided between the friction pad 61 and the inner surface of the outer shell 21 that sliding of the outer shell 21 relative to the inner shell 22 is prevented in at least normal use of the helmet.

In the arrangement depicted in FIG. 12, a rotating actuator 62 is provided to adjust the position of the friction pad 61 and/or the reaction force between the friction pad 61 and the inner surface of the outer shell 21. The rotating actuator 62 may be rotated between a first position, in which the switch operates in the first mode, and does not restrict relative sliding between the outer shell 21 and the inner shell 22, and the second mode, in which relative sliding is restricted.

The rotating actuator 62 may include finger holes (not shown in FIG. 12) to enable the user to rotate the rotating actuator between first and second positions. Alternatively or additionally, the rotating actuator 62 may be configured to receive a tool that a user may use in order to turn the rotating actuator 62. Any of any variety of configurations may be used to convert the rotary motion of the rotating actuator 61 into a linear motion that advances and retracts the friction pad 61, including for example a screw thread.

Figure 13:
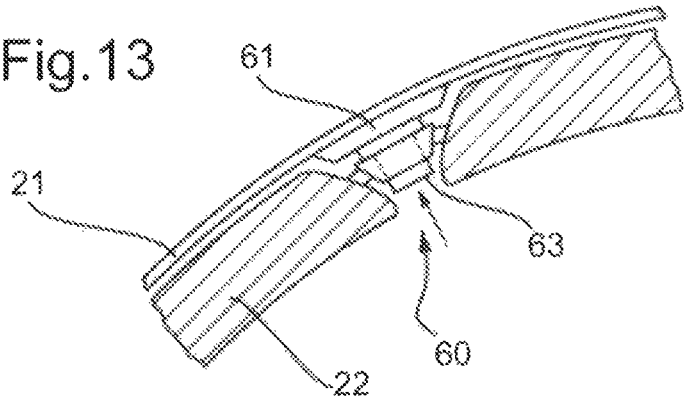
FIG. 13 depicts an arrangement of an interface engagement lock.

FIG. 13 depicts a variation of the arrangement shown in FIG. 12. In this arrangement, the friction pad 61 is driven by a push button 63. The push button mechanism may be configured such that, when first pressed, it advances the friction pad 61 towards the outer shell 21 in order to set the interface engagement locks 60 to the second mode, restricting sliding of the outer shell 21 relative to the inner shell 22. The push button mechanism may be further configured such that, when pressed a second time, the friction pad 61 is retracted from the outer shell 21, setting the interface engagement lock to the first mode.

As discussed above, one or more connectors may be provided between the first and second shell of a helmet that is configured to permit sliding between the two shells in the event of an impact on the helmet. Such connectors may be configured to permit sliding between the two shells in the event of a substantial impact but may minimise or reduce movement between the shells in the absence of an impact and/or may be configured to prevent the two shells from separating in the absence of an impact. In an arrangement, the switch that is configured to switch between first and second modes enabling and restricting sliding of the inner shell relative to the outer shell of the helmet, may include such a connector. Although such a connector may be configured to prevent the inner shell and the outer shell from separating in the absence of an impact, the connector may permit relative sliding in the event of an impact to the helmet.

Figure 14:
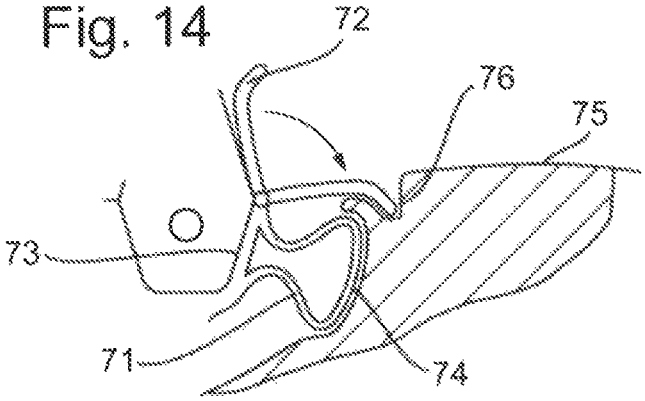
FIG. 14 depicts an arrangement in which a lock is provided in conjunction with a connector between two shells of a helmet.

FIG. 14 depicts an arrangement in which a connector 71 is combined with a switch 72. In the arrangement shown, the connector 71 is provided by elongate resilient components connected at a first end 73 to one shell of the helmet and at the second end 74 to another shell of the helmet. During relative sliding of the two shells, the resilient elements flex, permitting the separation between the first and second ends 73, 74 of the connector 71 to change, in turn permitting relative sliding of the two shells.

As shown, the lock 72 associated with the connector 71 may be arranged such that it is mounted at one end 73 of the connector to one of the shells of the helmet. The lock 72 is further configured such that it can be switched between a first position, in which it does not engage with the helmet shell 75 other than the shell to which it is mounted, and a second position, in which the lock 72 engages with the shell other than the one to which it is mounted such that the lock 72 prevents movement between the first and second ends 73, 74 of the connector 71. Accordingly, in the second position, the lock 72 prevents relative sliding of the two shells of the helmet. In the arrangement shown in FIG. 14, the lock 72 is configured as a rotatably mounted lock 72 that engages with a recess 76 in the opposing shell 75. However, it should be appreciated that, with appropriate modifications, any of the lock arrangements discussed above may be used in combination with a connector.

In an arrangement, the switch may be configured such that, rather than being merely provided in conjunction with a connector 71, the switch is integrally formed with the connector. In particular, the switch may be configured such that, in the first mode the connector functions unimpeded but, in the second mode, the switch prevents the connector from functioning in a way that permits relative sliding of the shells of the helmet.

Figure 15:
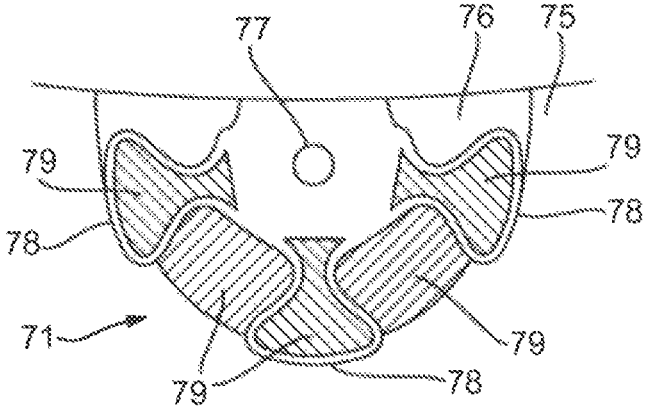
FIG. 15 depicts and arrangement in which a connector between two shells of a helmet includes an integrally formed switch.

Such an arrangement may be provided, for example, in an arrangement such as that depicted in FIG. 15, in which the connector 71 is formed from a plurality of elongate resilient elements that, under loading, may deform to permit movement between a first part 77 of the connector 71, mounted to a first helmet shell 76, and one or more parts 78, connected to a second shell 75. The switch may comprise one or more removable inserts 79 that may fill the space between the first part 77 of the connector 71 and the second part of the connector 78.

The one or more removable inserts 79 may be stiffer than the resilient elements forming the connector such that it prevents movement between the first and second parts 77, 78 of the connector 71, namely prevents the resilient elements from deforming.

In the first mode, the one or more insert members 79 may be positioned such that they do not engage with the connector 71 and therefore do not prevent movement between the first and second ends 77, 78 of the connector. Accordingly, sliding between the helmet shells may not be restricted.

In the second mode, the one or more insert members 79 engage with the connector 71 such that the first and second parts 77, 78 may not move relative to one another, which restricts sliding between the two shells of the helmet.

It should be appreciated that, although the arrangement depicted in FIG. 15 appears to show a plurality of insert members 79, these may be connected together above the plane of the figure in order to provide a single insert member that may be inserted into, and removed from, the connector by a user. It should also be appreciated that, in the first mode, the one or more insert members may be retained in the helmet and/or connector in a position that does not prevent relative movement of the first and second parts 77, 78 of the connector. Alternatively, the one or more insert members 79 may be configured such that, in the first mode, the user completely removes the one or more insert members from the helmet.

The invention claimed is:

1. A helmet comprising:

an inner shell configured to extend in front of a wearer's forehead and behind a back of the wearer's head in use;

an outer shell configured to extend in front of the wearer's forehead and behind the back of the wearer's head in use;

a sliding interface between the inner shell and the outer shell; and a switch selectively switchable between first and second discrete modes, the first discrete mode allowing relative sliding between the inner shell and the outer shell at the sliding interface in response to an impact to the helmet to provide protection against oblique impacts, the second discrete mode preventing relative sliding between the inner shell and the outer shell at the sliding interface.

2. A helmet according to claim 1, wherein the switch comprises a movable lock; the movable lock is movable between a first position and a second position, and the first and second discrete modes correspond to the first and second positions, respectively, of the movable lock;

in the first position, the lock does not engage with least one of the inner shell and the outer shell; and in the second position, respective parts of the lock engage with the inner shell and the outer shell to prevent relative sliding between the inner shell and the outer shell.

3. A helmet according to claim 2, wherein the movable lock is mounted to one of the inner shell and the outer shell; and, when the movable lock is in the second position, a part of the movable lock is inserted in a recess in the other of the inner shell and outer shell.

4. A helmet according to claim 3, wherein an end of the movable lock is rotatably attached to said one of the inner shell and the outer shell; and, in moving from the first position and the second position, the movable lock is rotated about said end of the movable lock.

5. A helmet according to claim 3, wherein the movable lock is slidably mounted to said one of the inner shell and outer shell to enable the lock to move from the first position to the second position.

6. A helmet according to claim 5, wherein the movable lock is configured such that, in sliding from the first position to the second position, a protrusion of the movable lock may extend at an angle relative to a direction in which the movable lock slides; and, in the second position, said protrusion is inserted in said recess.

7. A helmet according to claim 5, wherein the movable lock comprises a protrusion arranged such that, when the movable lock is in the first position, the protrusion is not aligned with the recess, and the movable lock is configured such that, when the movable lock slides to the second position, the protrusion is aligned with and is biased to enter said recess.

8. A helmet according to claim 3, wherein the part of the movable lock is a first part of the movable lock that may be inserted into said recess in said other of the inner shell and the outer shell by deforming part of the movable lock; and the movable lock further comprises a second part of the movable lock that is fixedly secured to said one of the inner shell and outer shell on which the movable lock is mounted.

9. A helmet according to claim 2, wherein the helmet has an edge, and said movable lock is mounted at the edge of the helmet.

10. A helmet according to claim 2, comprising a plurality of said movable locks.

11. A helmet according to claim 10, wherein a first of said plurality of movable locks restricts movement of the inner shell relative to the outer shell in a first direction; and a second of said plurality of movable locks restricts movement of the inner shell relative to the outer shell in a second direction, different from said first direction.

12. A helmet according to claim 1, wherein the switch comprises an interface engagement lock configured such that, in the second discrete mode, the interface engagement lock fixes a portion of an outer surface of the inner shell to a portion of an inner surface of the outer shell such that the interface engagement lock prevents relative sliding between the portion of the outer surface of inner shell and the portion of the inner surface of the outer shell.

13. A helmet according to claim 12, wherein the interface engagement lock comprises a friction pad mounted on one of the inner shell and outer shell; and the interface engagement lock is configured such that, in the second discrete mode, the friction pad contacts the other of the inner shell and the outer shell with sufficient force that the friction prevents relative sliding between the inner shell and the outer shell.

14. A helmet according to claim 13, wherein the interface engagement lock comprises a rotating actuator that, on rotation in respective first and second directions, retracts and advances the friction pad in order to switch the interface engagement lock between the first and second discrete modes, respectively.

15. A helmet according to claim 13, wherein the interface engagement lock comprises a push button switch that, when pressed, advances the friction pad in order to set the interface engagement lock to the second discrete mode.

16. A helmet according to claim 1, wherein the switch comprises a connector for connecting the inner shell and the outer shell; and the connector is configured such that, in the first discrete mode, the connector permits relative sliding between the inner shell and the outer shell.

17. A helmet according to claim 16, wherein the switch further comprises a removable insert member;

in the first discrete mode, the removable insert member is positioned such that no part of the removable insert member is engaged with the connector; and in the second discrete mode, the removable insert member is engaged with the connector such that the connector does not allow relative sliding between the inner shell and the outer shell at the sliding interface.

18. A helmet according to claim 1, wherein the switch is configured to be manually switchable between the first and second discrete modes by the wearer of the helmet and/or the switch is configured to be switchable without requiring the use of a tool.

19. A helmet according to claim 1, wherein the inner shell is configured to contact the head of the wearer, and the outer shell is an energy absorbing shell for absorbing impact energy.

20. A helmet according to claim 1, wherein the inner shell is a first energy absorbing shell for absorbing impact energy and the outer shell is a second energy absorbing shell for absorbing impact energy.

* * * * *